US010971821B2

(12) United States Patent
Choi et al.

(10) Patent No.: US 10,971,821 B2
(45) Date of Patent: Apr. 6, 2021

(54) CHIP ANTENNA MODULE

(71) Applicant: Samsung Electro-Mechanics CO., Ltd., Suwon-si (KR)

(72) Inventors: Seong Hee Choi, Suwon-si (KR); Sang Jong Lee, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 46 days.

(21) Appl. No.: 16/454,605

(22) Filed: Jun. 27, 2019

(65) Prior Publication Data

US 2020/0136255 A1 Apr. 30, 2020

(30) Foreign Application Priority Data

Oct. 26, 2018 (KR) ..... 10-2018-0129102

(51) Int. Cl.

| | |
|---|---|
| ***H01Q 1/22*** | (2006.01) |
| ***H01Q 1/38*** | (2006.01) |
| ***H01Q 9/04*** | (2006.01) |
| ***H01Q 1/48*** | (2006.01) |
| ***H01Q 1/24*** | (2006.01) |

(52) U.S. Cl.

CPC ..... *H01Q 9/045* (2013.01); *H01Q 1/2283* (2013.01); *H01Q 1/2291* (2013.01); *H01Q 1/243* (2013.01); *H01Q 1/48* (2013.01)

(58) Field of Classification Search

CPC ..... H01Q 1/2283; H01Q 1/2291; H01Q 1/22; H01Q 1/24; H01Q 1/243; H01Q 1/38; H01Q 1/48; H01Q 9/04; H01Q 9/045; H01Q 1/46

See application file for complete search history.

(56) References Cited

U.S. PATENT DOCUMENTS

| | | | | |
|---|---|---|---|---|
| 5,898,403 | A * | 4/1999 | Saitoh | H01Q 1/38 333/185 |
| 6,111,544 | A * | 8/2000 | Dakeya | H01Q 1/243 343/700 MS |
| 7,646,344 | B2 * | 1/2010 | Liu | H01Q 21/065 343/700 MS |
| 9,472,859 | B2 * | 10/2016 | Dang | H01Q 21/0075 |
| 9,837,701 | B2 * | 12/2017 | Yen | H01L 23/3128 |
| 10,547,119 | B2 * | 1/2020 | Kim | H01Q 1/523 |
| 2016/0079673 | A1 * | 3/2016 | Chiu | H01Q 1/48 343/843 |
| 2018/0048075 | A1 | 2/2018 | Park et al. | |

FOREIGN PATENT DOCUMENTS

| | | |
|---|---|---|
| JP | 2000-232315 A | 8/2000 |
| KR | 10-2018-0017667 A | 2/2018 |

* cited by examiner

*Primary Examiner* — Tho G Phan
(74) *Attorney, Agent, or Firm* — NSIP Law

(57) ABSTRACT

A chip antenna module includes: a chip antenna including a body portion, a radiating portion, and a grounding portion, wherein the body portion is formed of a dielectric substance, and wherein the radiating portion and the grounding portion are disposed on different surfaces of the body portion from each other; and a substrate having a plurality of layers and including feeding pads bonded to the radiating portion, grounding pads bonded to the grounding portion, and dummy wiring layers disposed on at least one layer among the plurality of layers, below the feeding pads, wherein a resonance frequency of the chip antenna is determined by a number of the dummy wiring layers.

18 Claims, 8 Drawing Sheets

CHIP ANTENNA MODULE

CROSS-REFERENCE TO RELATED APPLICATIONS

This application claims the benefit under 35 U.S.C. § 119(a) of Korean Patent Application No. 10-2018-0129102 filed on Oct. 26, 2018 in the Korean Intellectual Property Office, the entire disclosure of which is incorporated herein by reference for all purposes.

BACKGROUND

1. Field

The following description relates to a chip antenna module.

2. Description of Related Art

A 5G communications system is implemented in higher frequency (mmWave) bands, e.g., 10 GHz to 100 GHz bands, to achieve higher data transfer rates. In order to reduce propagation loss of radio waves and increase a transmission distance of radio waves, beamforming, large-scale multiple-input multiple-output (MIMO), full-dimensional MIMO (FD-MIMO), array antennas, analog beamforming, and large-scale antenna techniques are considered for implementation in the 5G communications system.

Mobile communications terminals such as a cellular phone, a personal digital assistant (PDA), a navigation device, a notebook computer, and the like, supporting wireless communications, have been developed to have functions such as code division multiple access (CDMA), a wireless local area network (WLAN), digital multimedia broadcasting (DMB), near field communications (NFC), and the like. One of the most important components enabling these functions is an antenna. Since a wavelength is as small as several millimeters in a millimeter wave communications band, it is difficult to use a conventional antenna. Therefore, a chip antenna module that is suitable for the millimeter wave communications band is desirable.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a chip antenna module includes: a chip antenna including a body portion, a radiating portion, and a grounding portion, wherein the body portion is formed of a dielectric substance, and wherein the radiating portion and the grounding portion are disposed on different surfaces of the body portion from each other; and a substrate having a plurality of layers and including feeding pads bonded to the radiating portion, grounding pads bonded to the grounding portion, and dummy wiring layers disposed on at least one layer among the plurality of layers, below the feeding pads, wherein a resonance frequency of the chip antenna is determined by a number of the dummy wiring layers.

The resonance frequency may decrease as the number of the dummy wiring layers increases.

A feed wiring layer configured to provide a feed signal to the feeding pads may be disposed on one or more layers among the plurality of layers.

The feed wiring layer and the dummy wiring layers may be disposed on different layers, among the plurality of layers, from each other.

The feeding pads and the feed wiring layer may be connected to each other through a feeding via extending in a thickness direction of the substrate.

The feeding pads and at least one of the dummy wiring layers may be connected to each other through the feeding via.

The feeding via may include a plurality of feeding vias, and the resonance frequency may be further determined by a number of feeding vias, among the plurality of feeding vias, connecting the feeding pads and at least one of the dummy wiring layers to each other.

The feeding via may include a plurality of feeding vias, and the resonance frequency may increase as a number of feeding vias, among the plurality of feeding vias, increases.

In another general aspect, a chip antenna module includes: a substrate including a plurality of layers; and a chip antenna including a body portion, a radiating portion, and a grounding portion. The body portion is formed of a dielectric substance, and the radiating portion and the grounding portion are disposed on different surfaces of the body portion from each other and extend in one direction. The body portion, the radiating portion, and the grounding portion are mounted to face the substrate. The substrate further includes a feeding pad bonded to the radiating portion, and a dummy wiring layer disposed on at least one layer among the plurality of layers, below the feeding pad, and having a shape corresponding to the feeding pad. A resonance frequency of the chip antenna is determined by a length of the dummy wiring layer.

The length of the dummy wiring layer may be equal to a length of the feeding pad.

The length of the dummy wiring layer may be less than a length of the feeding pad.

The length of the dummy wiring layer may be greater than a length of the feeding pad.

The resonance frequency may decrease as the length of the dummy wiring layer increases.

The feeding pad and the dummy wiring layer may be connected to each other by a feeding via extending in a thickness direction of the substrate.

The feeding via may include a plurality of feeding vias. The resonance frequency may be determined by a number of feeding vias, among the plurality of feeding vias, connecting the feeding pad and the dummy wiring layer to each other.

The resonance frequency may increase as the number of the feeding vias increases.

The substrate may further include a feed wiring layer disposed on a layer, among the plurality of layers, between the dummy wiring layer and the feeding pad, and configured to provide a feed signal to the feeding pad.

The substrate may further include a feed wiring layer disposed on a layer, among the plurality of layers, below the dummy wiring layer, and configured to provide a feed signal to the feeding pad.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
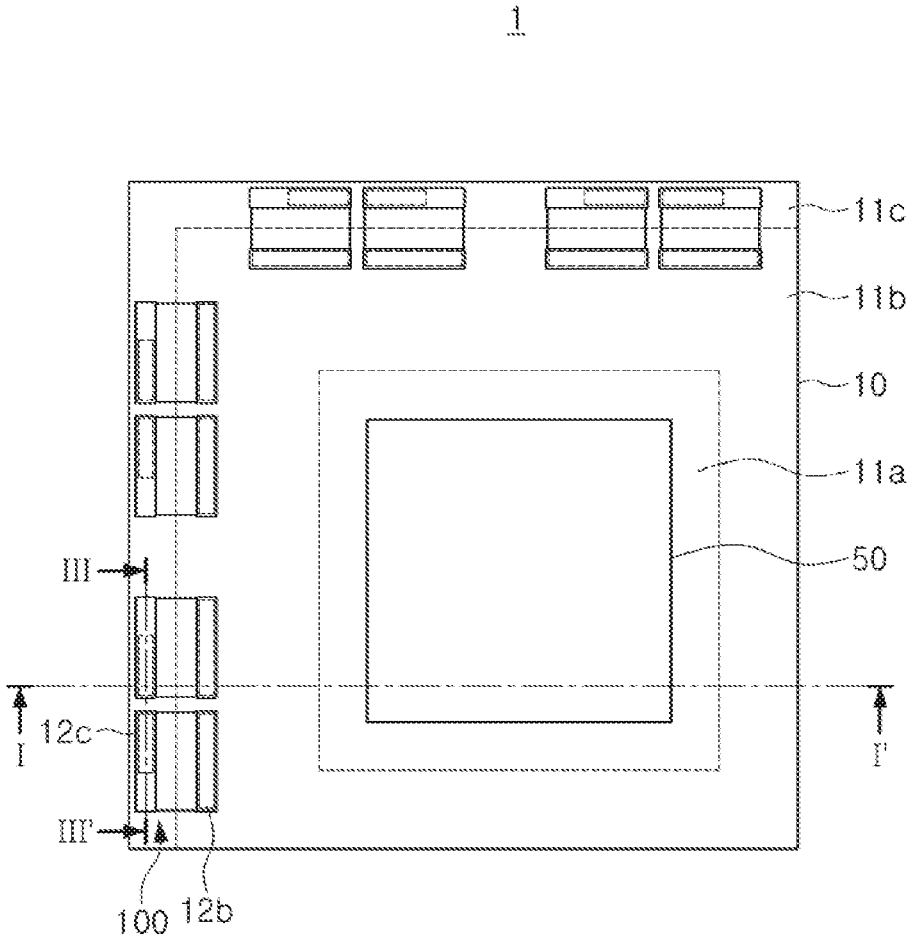
FIG. 1 is a plan view of a chip antenna module, according to an embodiment.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

Herein, it is noted that use of the term "may" with respect to an example or embodiment, e.g., as to what an example or embodiment may include or implement, means that at least one example or embodiment exists in which such a feature is included or implemented while all examples and embodiments are not limited thereto.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

As used herein, the term "and/or" includes any one and any combination of any two or more of the associated listed items.

Although terms such as "first," "second," and "third" may be used herein to describe various members, components, regions, layers, or sections, these members, components, regions, layers, or sections are not to be limited by these terms. Rather, these terms are only used to distinguish one member, component, region, layer, or section from another member, component, region, layer, or section. Thus, a first member, component, region, layer, or section referred to in examples described herein may also be referred to as a second member, component, region, layer, or section without departing from the teachings of the examples.

Spatially relative terms such as "above," "upper," "below," and "lower" may be used herein for ease of description to describe one element's relationship to another element as shown in the figures. Such spatially relative terms are intended to encompass different orientations of the device in use or operation in addition to the orientation depicted in the figures. For example, if the device in the figures is turned over, an element described as being "above" or "upper" relative to another element will then be "below" or "lower" relative to the other element. Thus, the term "above" encompasses both the above and below orientations depending on the spatial orientation of the device. The device may also be oriented in other ways (for example, rotated 90 degrees or at other orientations), and the spatially relative terms used herein are to be interpreted accordingly.

The terminology used herein is for describing various examples only, and is not to be used to limit the disclosure. The articles "a," "an," and "the" are intended to include the plural forms as well, unless the context clearly indicates otherwise. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Due to manufacturing techniques and/or tolerances, variations of the shapes shown in the drawings may occur. Thus, the examples described herein are not limited to the specific shapes shown in the drawings, but include changes in shape that occur during manufacturing.

The features of the examples described herein may be combined in various ways as will be apparent after an understanding of the disclosure of this application. Further, although the examples described herein have a variety of configurations, other configurations are possible as will be apparent after an understanding of the disclosure of this application.

A chip antenna module described herein can operate in a radio frequency region, and for example, can operate in a frequency band between 3 GHz and 30 GHz. In addition, the chip antenna module may be mounted in an electronic device configured to receive, or transmit and receive, a radio signal. For example, the chip antenna may be mounted in a portable telephone, a portable notebook PC, a drone, or the like.

Figure 2:
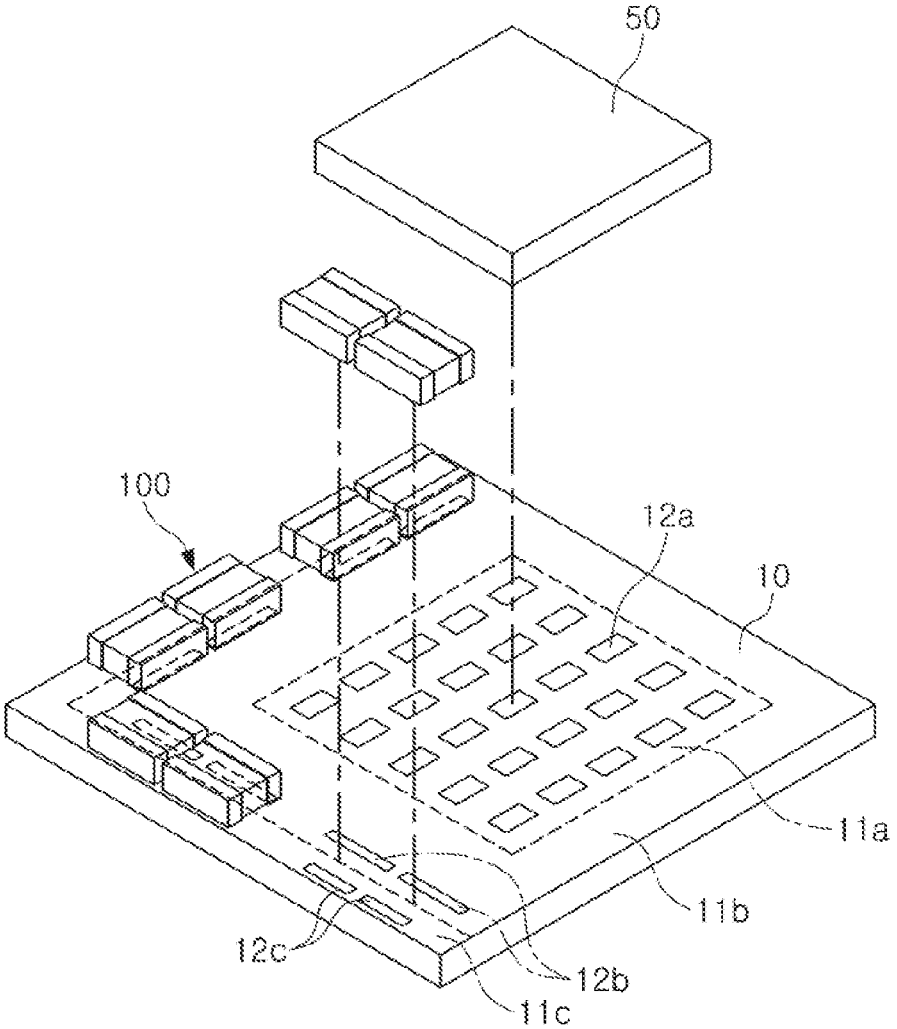
FIG. 2 is an exploded perspective view of the chip antenna module illustrated in FIG. 1.
Figure 3:
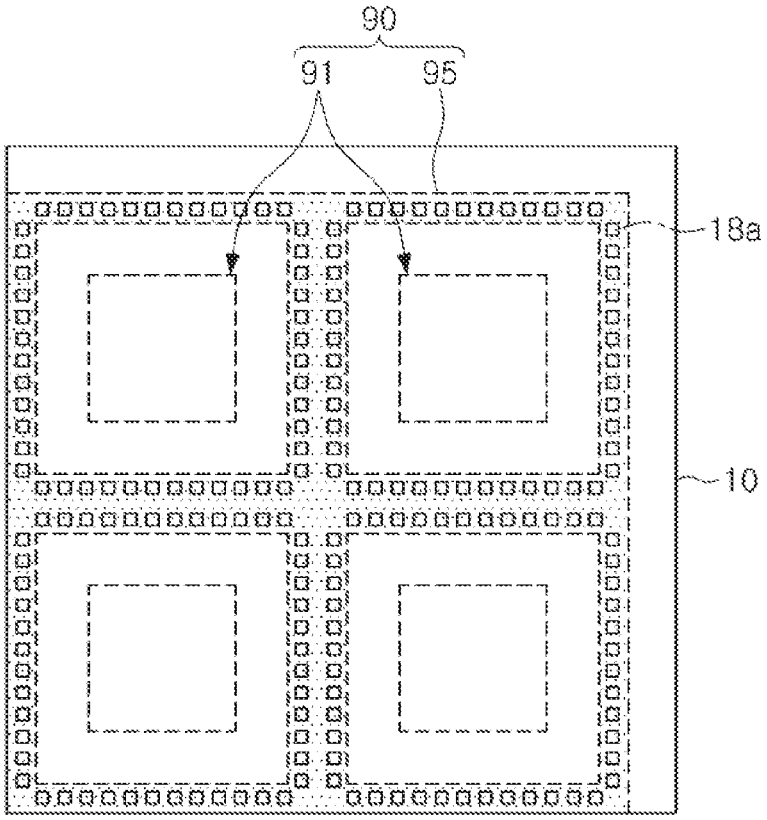
FIG. 3 is a bottom view of the chip antenna module illustrated in FIG. 1.

FIG. 1 is a plan view of a chip antenna module 1, according to an embodiment. FIG. 2 is an exploded perspective view of the chip antenna module 1. FIG. 3 is a bottom view of the chip antenna module 100. Furthermore, FIG. 4 is a cross-sectional view taken along line I-I' of FIG. 1.

Referring to FIG. 1 through FIG. 4, the chip antenna module 1 includes a substrate 10, an electronic component 50, and a chip antenna 100.

The substrate 10 may be a circuit used in a wireless antenna, or a circuit board on which electronic components are mounted. For example, the substrate 10 may be a printed circuit board (PCB) containing at least one electronic component therein or including at least one electronic component mounted on a surface thereof. Accordingly, the substrate 10 may include a circuit wiring line electrically connecting electronic components.

Figure 4:
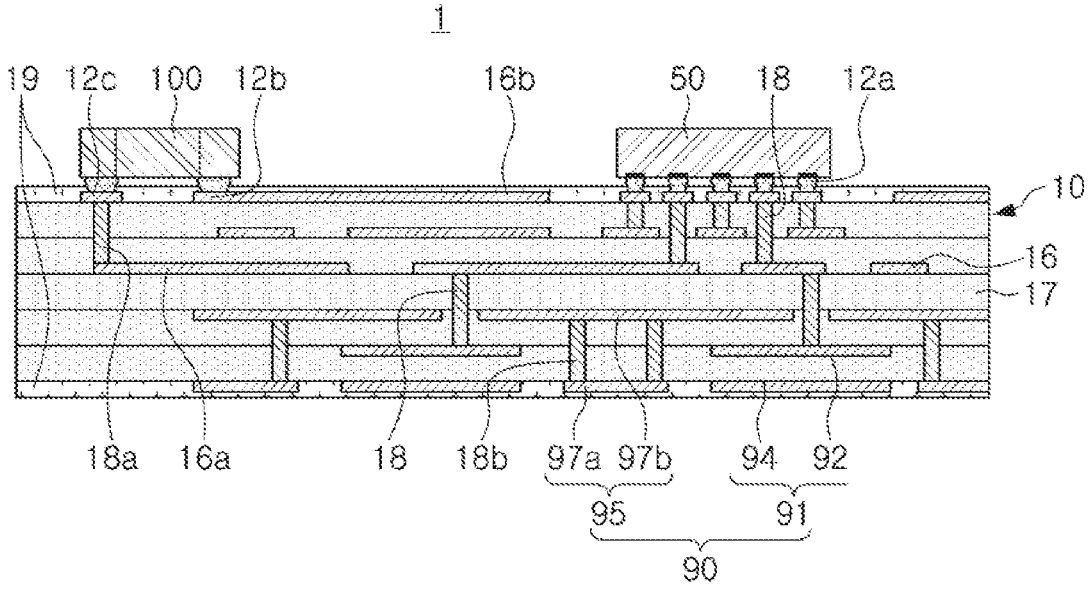
FIG. 4 is a cross-sectional view taken along line I-I" of FIG. 1.

Referring to FIG. 4, the substrate 10 may be a multi-layered substrate in which insulating layers 17 and wiring layers 16 are repeatedly stacked one on top of the other. In some examples, wiring layers 16 may be respectively disposed on both surfaces of a single insulating layer 17.

The insulating layers 17 may be formed of an insulating material. Examples of the insulating material include but are not limited to thermosetting resin such as epoxy resin, thermoplastic resin such as polyimide, and resin in which the thermosetting resin or the thermoplastic resin is impregnated with inorganic filler in a core material such as glass fiber, glass cloth, and glass fabric, such as prepreg, Ajinomoto build-up film (ABF), FR-4, and bismaleimide triazine (BT). Alternatively, photo-imageable dielectric (PID) resin can be also used for the insulating layers 17.

Still referring to FIG. 4, the wiring layers 16 electrically connect the electronic component 50, which will be described below, to antennas 90 and 100. Furthermore, the wiring layers 16 electrically connect the electronic component 50 or the antennas 90 and 100 to an external component.

The wiring layers 16 may be formed of a conductive material, such as copper (Cu), aluminum (Al), silver (Ag), tin (Sn), gold (Au), nickel (Ni), lead (Pb), titanium (Ti), and an alloy thereof.

Interlayer connection conductors 18 are disposed inside the insulating layers 17 to connect the stacked wiring layers 16 to each other.

An insulating protective layer 19 may be disposed on a surface of the substrate 10. That is, the insulating protective layer 19 is disposed on either one or both of an upper surface and a lower surface of the substrate 10 so as to cover and thereby protect both the insulating layer 17 and the wiring layer 16 disposed therebelow.

The insulating protective layer 19 may have an opening portion formed therein which exposes at least a portion of an outermost (e.g., an uppermost or lowermost) wiring layer 16. The insulating protective layer 19 may contain an insulating resin and an inorganic filler. The insulating protective layer 19 may not contain glass fiber. For example, the insulating protective layer 19 may include a solder resist. A substrate of various types well known in the related art (for example, a printed circuit board, a flexible substrate, a ceramic substrate, a glass substrate, etc.) may be used for the substrate 10.

As shown in FIGS. 1 and 2, the upper surface of the substrate 10, referred to herein as first surface of the substrate 10, may include a component mounting region 11*a*, a grounding region 11*b*, and a feeding region 11*c*.

The component mounting region 11*a* is a region in which the electronic component 50 is mounted. The component mounting region 11*a* is disposed within the grounding region 11*b*, which will be described below. Connection pads 12*a* to which the electronic component 50 is electrically connected are disposed in the component mounting region 11*a*.

As shown in FIGS. 1-2 and 4, the grounding region 11*b* is a region in which a grounding wiring layer 16*b* is disposed. The grounding region 11*b* is disposed so as to surround the component mounting region 11*a*. Accordingly, the component mounting region 11*a* is disposed within the grounding region 11*b*.

As shown in FIG. 4, one of the wiring layers 16 of the substrate 10 may be used as the grounding wiring layer 16*b*. Accordingly, the grounding wiring layer 16*b* may be disposed on an upper surface of an uppermost insulating layer 17 or may be disposed between two insulating layers 17 stacked one on top of the other.

In an example, the component mounting region 11*a* is substantially rectangular in shape, as shown in FIGS. 1 and 2. Accordingly, the grounding region 11*b* is disposed in the shape of a rectangular ring that surrounds the component mounting region 11*a*. The shape of the component mounting region 11*a* may vary depending on examples.

Since the grounding region 11*b* is disposed along an edge of the component mounting region 11*a*, the connection pads 12*a* in the component mounting region 11*a* are electrically connected to an external component or other components through the interlayer connection conductors 18 passing through the insulating layers 17 of the substrate 10, as shown in FIG. 4.

Referring to FIGS. 1, 2, and 4, grounding pads 12*b* are disposed in the grounding region 11*b*. As shown in FIG. 4, when the grounding wiring layer 16*b* is disposed on the upper surface of the uppermost insulating layer 17, the grounding pads 12*b* may be formed by partially perforating the insulating protective layer 19 covering the grounding wiring layer 16*b*. Accordingly, in this case, the grounding pads 12*b* are formed as part of the grounding wiring layer 16*b*. However, the grounding wiring layer 16*b* is not limited to such a configuration and may be disposed between two insulating layers 17 stacked one on top of the other. In such an example, the grounding pads 12*b* are disposed on top of an upper insulating layer 17 of the two insulating layers 17, and the grounding pads 12*b* and the grounding wiring layer 16*b* may be connected to each other through an interlayer connection conductor 18.

A grounding pad 12*b* is disposed to form a pair with a feeding pad 12*c*, which will be described below. Therefore, the grounding pad 12*b* is disposed adjacent to the feeding pad 12*c*, as shown in FIGS. 1, 2, and 4.

As shown in FIGS. 1 and 2, the feeding region 11*c* is disposed outside the grounding region 11*b*. In an example, the feeding region 11*c* is disposed adjacent to two outer sides of the grounding region 11*b*. Accordingly, the feeding region 11*c* is disposed along an outer edge of the substrate 10. However, the configuration of the feeding region 11*c* is not limited the foregoing example.

Figure 5:
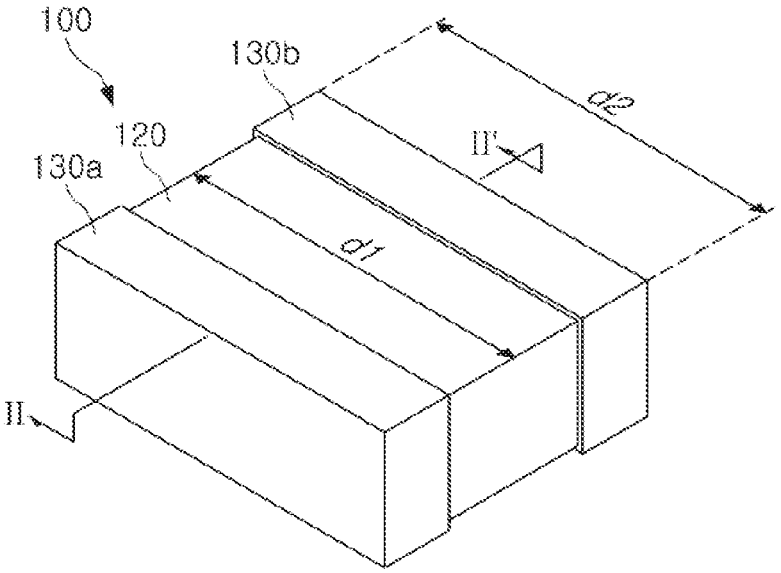
FIG. 5 is an enlarged perspective view of a chip antenna of the chip antenna module illustrated in FIG. 1.

A plurality of feeding pads 12*c* are disposed in the feeding region 11*c*, as shown in FIGS. 1 and 2. The feeding pads 12*c* are disposed on an upper surface of the uppermost insulating layer 17 and are bonded to a radiating portion 130*a* of the chip antenna 100, as shown in FIGS. 4 and 5.

As illustrated in FIG. 4, the feeding pads 12*c* are electrically connected to the electronic component 50 or other components through the feeding via 18*a* passing through the insulating layer 17, and a feed wiring layer 16*a*. The feeding pads 12*c* receive a feed signal through the feeding via 18*a* and the feed wiring layer 16*a*.

The component mounting region 11*a*, the grounding region 11*b*, and the feeding region 11*c* are distinguished from one another by shapes or positions of the grounding wiring layer 16*b* disposed thereon. Also, the connection pads 12*a*, the grounding pads 12*b*, and the feeding pads 12*c* are externally exposed in the shape of pads through opening portions of the insulating protective layer 19.

The feeding pad 12*c* is formed to have a length or an area identical to a length or an area of a lower surface of the radiating portion 130*a* of the chip antenna 100. However, in some examples, the feeding pad 12*c* may be formed to have a length or area less than or equal to half of the length or area of the lower surface of the radiating portion 130*a*. In such examples, the feeding pad 12*c* is bonded not to the entire lower surface of the radiating portion 130*a*, but only to a portion of the lower surface of the radiating portion 130*a*.

As shown in FIGS. 3 and 4, a patch antenna 90 is disposed on a lower surface of the substrate 10, herein referred to as a second surface of the substrate 10. The patch antenna 90 is formed by the wiring layers 16 disposed on the substrate 10.

As illustrated in FIG. 3 and FIG. 4, the patch antenna 90 includes at least one feed portion 91 including a feed patch 92 and a radiating patch 94, and at least one grounding portion 95.

In the illustrated example, the patch antenna 90 includes feed portions 91 arranged on the second surface of the substrate 10. In particular, in the illustrated example, the patch antenna 90 is illustrated as including four feed portions 91 and one grounding portion 95, but is not limited to such a configuration.

The feed patch 92 is formed as a flat metal layer having a fixed area and is formed by a single conductive plate. The feeding patch 92 may have a substantially polygonal structure, and has a rectangular shape in the illustrated example, but is not limited to such a configuration. Alternatively, the feed patch 92 may be formed in other shapes such as a circular shape.

The feed patch 92 may be connected to the electronic component 50 through an interlayer connection conductor 18, as shown in FIG. 4. More specifically, the interlayer connection conductor 18 may pass through a second grounding wiring layer 97*b* to be described later, to be connected to the electronic component 50.

The radiating patch 94 is spaced apart from the feed patch 92 by a fixed distance and is formed as a single flat conductive plate having a fixed area. The radiating patch 94 has an area that is identical or similar to an area of the feed patch 92. For example, the radiating patch 94 may be formed to have an area larger than the area of the feed patch 92 and positioned to face the entire feed patch 92.

The radiating patch 94 is disposed closer to the second surface side of the substrate 10 than the feed patch 92. Accordingly, the radiating patch 94 may be disposed on a lowermost wiring layer 16 of the substrate 10, and in this case, the radiating patch 94 is protected by an insulating protective layer 19 disposed on a lower surface of a lowermost insulating layer 17 of the substrate 10.

The grounding portion 95 is disposed to surround the feed portions 91. The grounding portion 95 includes a first grounding wiring layer 97*a*, a second grounding wiring layer 97*b*, and grounding vias 18*b*.

The first grounding wiring layer 97*a* is disposed on the same layer as the radiating patch 94. The first grounding wiring layer 97*a* is disposed in proximity to the radiating patch 94 so as to surround the radiating patch 94, and is spaced apart from the radiating patch 94 by a fixed distance.

The second grounding wiring layer 97*b* and the first grounding wiring layer 97*a* are disposed on different wiring layers 16 from each other. For example, the second grounding wiring layer 97*b* may be disposed between the feed patch 92 and the first surface of the substrate 10. In this case, the feed patch 92 is disposed between the radiating patch 94 and the second grounding wiring layer 97*b*.

The second grounding wiring layer 97*b* may be disposed on the entire surface of a single wiring layer 16. A portion of the second grounding wiring layer 97*b* may be removed for an interlayer connection conductor 18 connected to the feed patch 92 to pass through.

The grounding vias 18*b* are interlayer connection conductors electrically connecting the first grounding wiring layer 97*a* and the second grounding wiring layer 97*b* to each other, and are disposed so as to surround the feed patch 92 and the radiating patch 94. The grounding vias 18*b* are arranged in a single column in the illustrated example, but an arrangement of the grounding vias 18*b* is not limited to this configuration and may be variously modified. For example, the grounding vias 18*b* may be arranged in a plurality of columns in some examples. According to the configuration described above, the feed portion 91 is disposed within the grounding portion 95, which forms a shape similar to a container by virtue of the first grounding wiring layer 97*a*, the second grounding wiring layer 97*b*, and the grounding vias 18*b*.

The feed portion 91 of the patch antenna 90 radiates wireless signals in a thickness direction (in a downward direction, for example) of the substrate 10.

In the present example, the first grounding wiring layer 97*a* and the second grounding wiring layer 97*b* are not disposed on a region that faces the feed region 11*c*(FIG. 2) defined on the first surface of the substrate 10. This configuration is for the purpose of reducing interference between the grounding portion 95 and the wireless signals radiated from the chip antenna 100, which will be described below, and the first grounding wiring layer 97*a* and the second grounding wiring layer 97*b* are not limited to such a configuration.

Furthermore, although the illustrated example describes a case in which the patch antenna 90 includes the feed patch 92 and the radiating patch 94, the configuration of the patch antenna 90 may be variously modified. For example, the patch antenna 90 may be configured to include only the feed patch 92 if so needed.

The electronic component 50 is mounted in the component mounting region 11*a*, as shown in FIG. 1. The electronic component 50 may be bonded to the connection pads 12*a* in the component mounting region 11*a* by using a conductive adhesive.

The example disclosed herein describes a single electronic component 50 mounted in the component mounting region 11*a*, however, a plurality of electronic components 50 may be mounted in the component mounting region 11*a*, as needed.

The electronic component 50 may include at least one active component and may further include, for example, a signal processing component configured to transfer a feed signal to the radiating portion 130*a* of the antenna. The electronic component 50 may also include a passive component.

The chip antenna 100 is used for wireless communications in a frequency range of gigahertz, and is mounted on the substrate 10 to receive feed signals from the electronic component 50 and externally radiate the feed signals.

Figure 6:
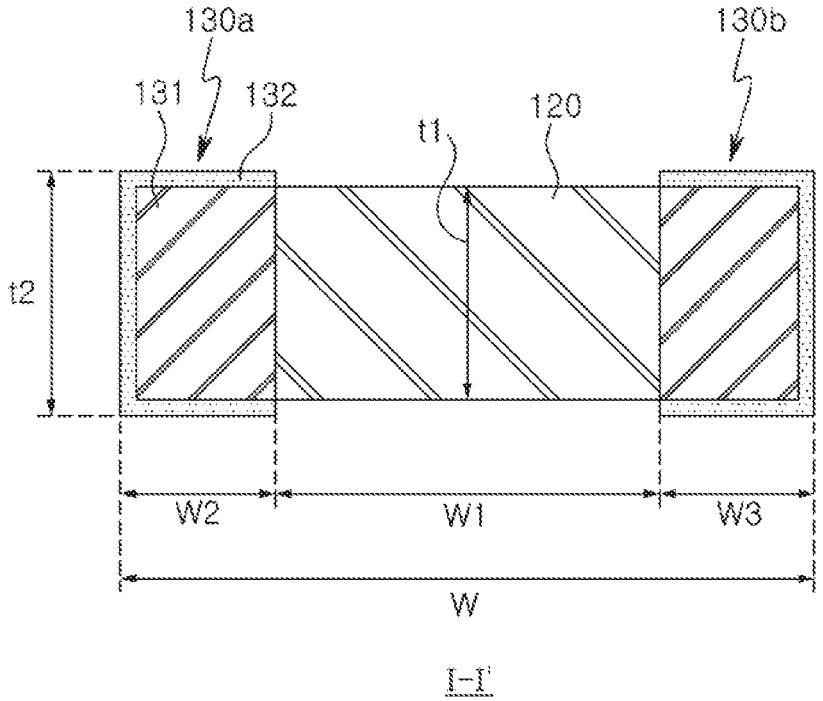
FIG. 6 is a cross-sectional view taken along line II-II' of FIG. 5.

FIG. 5 is an enlarged perspective view of the chip antenna 100 illustrated in FIG. 1. FIG. 6 is a cross-sectional view taken along line II-II' of FIG. 5.

The chip antenna 100 is formed in a substantially hexahedral shape. The chip antenna 100 is mounted on the substrate 10. As shown in FIG. 4, the chip antenna 100 has one end bonded to one of the feeding pads 12*c* of the substrate 10 and another end bonded to one of the grounding pads 12*b* of the substrate 10 by using a conductive adhesive such as solders.

Referring to FIG. 5 and FIG. 6, the chip antenna 100 includes a body portion 120, a radiating portion 130*a*, and a grounding portion 130*b*.

The body portion 120 is formed of a dielectric substance in a substantially hexahedral shape. For example, the body portion 120 may be formed of a polymer or a ceramic sintered body having a dielectric constant.

The chip antenna 100 is a chip antenna capable of operating in a 3-30 GHz frequency range.

The body portion 120 of the chip antenna 100 is formed of a material having a dielectric constant in the range of 3.5-25.

The radiating portion 130*a* is bonded to the first surface of the body portion 120. The grounding portion 130*b* is bonded to the second surface of the body portion 120. The first surface and the second surface refer to two opposing surfaces of the body portion 120 formed in a substantially hexahedral shape.

In the illustrated example, a width W1 of the body portion 120 is defined by a distance between the first surface of the body portion 120 and the second surface of the body portion 120. Accordingly, the direction from the first surface toward the second surface of the body portion 120 (or the direction from the second surface to the first surface of the body portion 120) is defined as a width direction of the body portion 120 or the chip antenna 100.

A width W2 of the radiating portion 130*a* and a width W3 of the grounding portion 130*b* are each defined as a distance in a width direction of the chip antenna 100. The width W2 of the radiating portion 130*a* refers to a shortest distance from a bonding surface of the radiating portion 130*a* bonded to the first surface of the body portion 120, to a surface of the radiating portion 130*a* opposing the bonding surface of the radiating portion 130*a*. The width W3 of the grounding portion 130*b* refers to a shortest distance from a bonding surface of the grounding portion 130*b* bonded to the second surface of the body portion 120, to a surface of the grounding portion 130*b* opposing the bonding surface of the grounding portion 130*b*.

The radiating portion 130*a* is bonded to the body portion 120 while making contact with only one surface among six surfaces of the body portion 120. Likewise, the grounding portion 130*b* is bonded to the body portion 120 while making contact with only one surface among six surfaces of the body portion 120. The radiating portion 130*a* and the grounding portion 130*b* are disposed only on the first and second surfaces of the body portion 120, and are disposed in parallel with each other with the body portion 120 interposed therebetween.

Chip antennas conventionally used in a low frequency band typically have a radiating portion and a grounding portion formed by thin films disposed on a lower surface of a body portion of a chip antenna, and thus have a relatively small distance between the radiating portion and the grounding portion causing a loss of radio-frequency signals due to inductance. Furthermore, since the distance between the radiating portion and the grounding portion cannot be precisely controlled in such a conventional chip antenna during the manufacturing process thereof, it is difficult to accurately predict capacitance, which results in difficulties in controlling a resonance point and impedance tuning.

In contrast to such a conventional chip antenna, the chip antenna 100 includes the radiating portion 130*a* and the grounding portion 130*b*, each formed in the shape of a block and bonded to the first surface and the second surface of the body portion 120, respectively. In the example described herein, the radiating portion 130*a* and the grounding portion 130*b* are each formed in a substantially hexahedral shape having six surfaces, and more particularly, one surface among six surfaces of the radiating portion 130*a* is bonded to the first surface of the body portion 120, and one surface among six surfaces of the grounding portion 130*b* is bonded to the second surface of the body portion 120.

When the radiating portion 130*a* and the grounding portion 130*b* are bonded only to the first surface and the second surface of the body portion 120, respectively, the distance between the radiating portion 130*a* and the grounding portion 130*b* is defined solely by the size of the body portion 120, and thus, the aforementioned issues associated with the conventional chip antenna can be prevented.

Furthermore, the chip antenna 100 forms capacitance by virtue of the dielectric substance between the radiating portion 130*a* and the grounding portion 130*b* (for example, the body portion), and thus may be used in the configuration of a coupling antenna or to tune resonance frequencies.

The radiating portion 130*a* may be formed of the same material as the grounding portion 130*b*. Furthermore, the radiating portion 130*a* may have the same shape structure as the grounding portion 130*b*. In this case, the radiating portion 130*a* and the grounding portion 130*b* can be distinguished from each other by the type of pads bonded thereto when mounted on the substrate 10.

For example, in the chip antenna 100, a component bonded to the feeding pads 12*c* of the substrate 10 may function as the radiating portion 130*a*, while a component bonded to the grounding pads 12*b* of the substrate 10 may function as the grounding portion 130*b*. However, the configuration of the chip antenna 100 is not limited to this example.

The radiating portion 130*a* and the grounding portion 130*b* each include a first conductor 131 and a second conductor 132. The first conductor 131 is a conductor directly bonded to the body portion 120 and formed in the shape of a block. The second conductor 132 is disposed as a layer along a surface of the first conductor 131.

The first conductor 131 may be formed on one surface of the body portion 120 by a printing process or a plating process and may be formed of one selected from Ag, Au, Cu, Al, Pt, Ti, Mo, Ni, and W, or may be formed of an alloy of two or more selected therefrom. Alternatively, the first conductor 131 may be formed of conductive epoxy or conductive paste containing an organic substance such as polymer and glass, in metal material.

The second conductor 132 may be formed on a surface of the first conductor 131 by a plating process. Without being limited thereto, the second conductor 132 may be formed by having a nickel (Ni) layer and a tin (Sn) layer sequentially stacked one on top of the other, or by having a zinc (Zn) layer and a tin (Sn) layer sequentially stacked one on top of the other.

Referring FIG. 5 and FIG. 6, a thickness t2 of each of the radiating portion 130*a* and the grounding portion 130*b* is greater than a thickness t1 of the body portion 120. Also, a length d2 of each of the radiating portion 130*a* and the grounding portion 130*b* is greater than a length d1 of the body portion 120. The first conductor 131 has a thickness and a length that are identical to the thickness t1 and the length d1 of the body portion 120, respectively.

Accordingly, each of the radiating portion 130*a* and the grounding portion 130*b* is formed to be thicker and longer than the body portion 120 by virtue of the second conductor 132 formed on the surface of the first conductor 131.

The chip antenna 100 can be used in a radio frequency band between 3 GHz and 30 GHz, and the chip antenna can be conveniently mounted in a thin portable device.

Since the radiating portion 130*a* and the grounding portion 130*b* are each in contact with only one surface of the body portion 120, resonance frequencies can be tuned conveniently. By controlling the size of the antenna, radiation efficiency of the antenna can be greatly enhanced. For example, by altering the length d1 of the body portion 120 and the length d2 of each of the radiating portion 130*a* and the grounding portion 130*b*, resonance frequencies of the chip antenna 100 can be conveniently controlled. However, since controlling the resonance frequencies by controlling the volume of the chip antenna 100 requires the distance between the chip antenna 100 and an adjacent chip antenna to be modified as well, tuning the resonance frequencies through controlling the volume of the chip antenna 100 often gives rise to various design limitations.

According to examples, as shown in FIGS. 7-12, a dummy wiring layer 16*c* may be provided below the feeding pad 12*c* connected to the radiating portion 130*a* of the chip antenna 100 to conveniently control resonance frequencies of the chip antenna 100.

FIG. 7 through FIG. 12 are cross-sectional views of chip antenna modules according to various examples, taken along line III-III' of FIG. 1.

Figure 7:
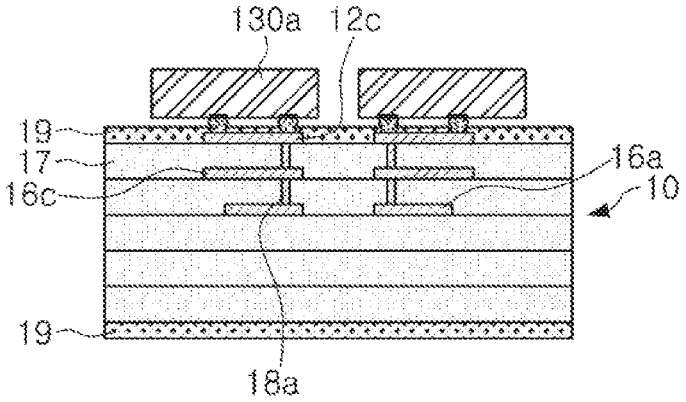
FIG. 7 through FIG. 12 are cross-sectional views of chip antenna modules, according to embodiments, taken along line III-III' of FIG. 1.

Referring to FIG. 7, the dummy wiring layer 16*c* may be disposed below the feeding pad 12*c* within the substrate 10. The dummy wiring layer 16*c* may be electrically connected to the feeding pad 12*c* through a feeding via 18*a*.

The dummy wiring layer 16*c* may be formed in a shape corresponding to the feeding pad 12*c* below the feeding pad 12*c*. For example, the dummy wiring layer 16*c* may be formed to have a length identical or similar to a length of the feeding pad 12*c*.

The dummy wiring layer 16*c* may be provided on one layer among a plurality of layers in the substrate 10. The dummy wiring layer 16*c* and the feed wiring layer 16*a* may be provided on different layers from each other. For example, the dummy wiring layer 16*c* may be provided between the feeding pad 12*c* and the feed wiring layer 16*a*. Alternatively, in some other examples, the dummy wiring layer 16*c* may be disposed below the feed wiring layer 16*a*.

Figure 8:
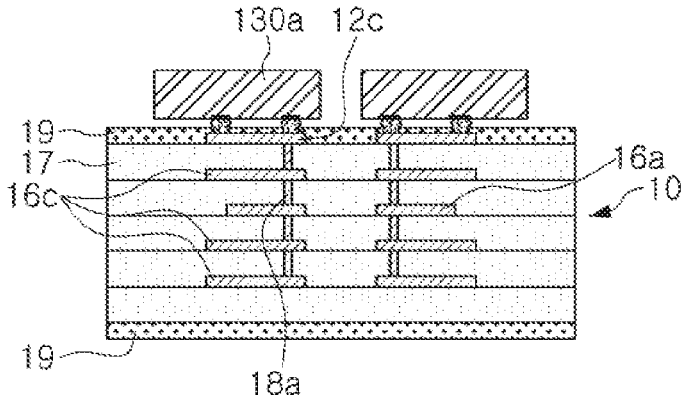

Although FIG. 7 illustrates a single dummy wiring layer 16*c* being disposed on a single layer in the substrate 10, the substrate 10 may include a plurality of dummy wiring layers 16*c* disposed on multiple layers in the substrate among the plurality of layers in the substrate, as shown in FIG. 8. The plurality of dummy wiring layers 16*c* may be provided on different layers from one another in the substrate 10 and may be electrically connected to the feeding pads 12*c* through the feeding vias 18*c*.

According to an example, one or more dummy wiring layers 16*c* are disposed below the feeding pad 12*c*, and a resonance frequency of the chip antenna 100 may be controlled by controlling the number of the dummy wiring layers 16*c*. For example, the resonance frequency of the chip antenna 100 may decrease as the number of the dummy wiring layers 16*c* increases.

Referring to FIG. 7, the dummy wiring layer 16*c* is disposed below the chip antenna 100 in a mounting direction of the chip antenna 100, is formed in a shape corresponding to the feeding pad 12*c*, and has a length similar or identical to a length of the feeding pad 12*c*. However, the dummy wiring layer 16*c* is not limited to such a configuration and, in some examples, the length of the dummy wiring layer 16*c* may be varied.

Figure 9:
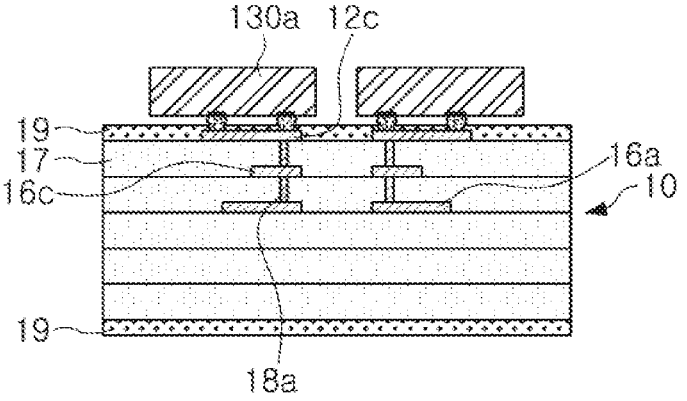
Figure 10:
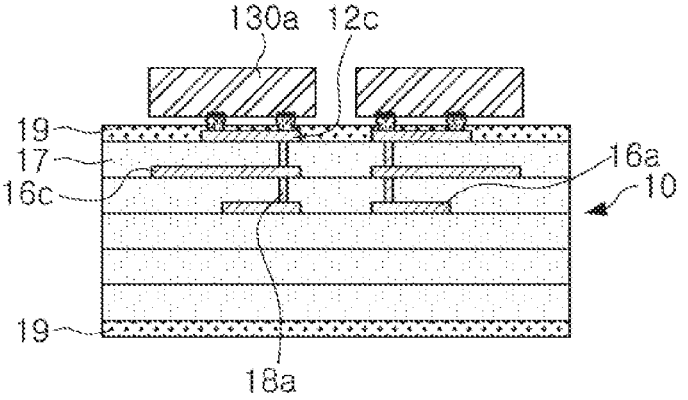

For example, as illustrated in FIG. 9, the length of the dummy wiring layer 16*c* may be less than a length of the feeding pad 12*c*, or as illustrated in FIG. 10, the length of the dummy wiring layer 16*c* may be greater than the length of the feeding pad 12*c*. The length of the dummy wiring layer 16*c* may be determined by a designed resonance frequency of the chip antenna 100.

According to an example, a resonance frequency of the chip antenna 100 may be controlled by controlling the length of the dummy wiring layer 16*c* provided below the feeding pad 12*c*. The resonance frequency of the chip antenna is determined by Equation 2 below.

$$\text{Resonance frequency}=1/(2\pi\sqrt{LC}) \quad (2)$$

Referring to Equation 2 above, as a length of the dummy wiring layer 16*c* increases, inductance L of an inductor and capacitance C of a capacitor in the chip antenna 100 increase, and thus the resonance frequency of the chip antenna 100 decreases. Alternatively, when the length of the dummy wiring layer 16*c* decreases, inductance L of the inductor and capacitance C of the capacitor in the chip antenna decrease, and thus the resonance frequency of the chip antenna 100 increases.

Figure 11:
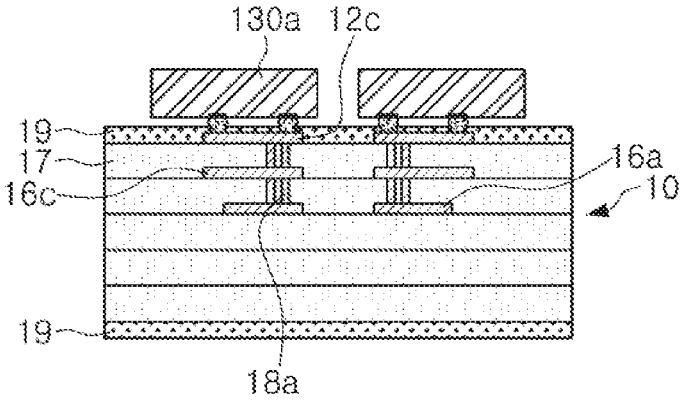
Figure 12:
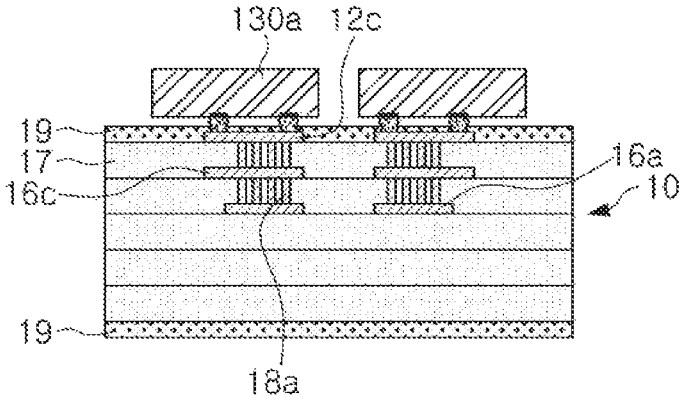

Although the dummy wiring layer 16*c* is illustrated in FIG. 7 as being connected to the feeding pad 12*c* through a single feeding via 18*a*, in some examples, the dummy wiring layer 16*c* and the feeding pad 12*c* may be connected to each other through a plurality of feeding vias 18*a*, as shown in FIGS. 11 and 12. The plurality of feeding vias 18*a* connecting the dummy wiring layer 16*c* to the feeding pad 12*c* may be evenly spaced out in a length direction of the feeding pad 12*c*.

As illustrated in FIG. 11, the dummy wiring layer 16*c* and the feeding pad 12*c* may be connected to each other through two feeding vias 18*a*, and as illustrated in FIG. 12, the dummy wiring layer 16*c* and the feeding pad 12*c* may be connected to each other through four feeding vias 18*a*. Although the feeding vias 18*a* are illustrated as being arranged in a single column in FIG. 11 and FIG. 12, in some examples, the feeding vias 18*a* may be disposed in a plurality of columns, and a plurality of columns of the feeding vias 18*a* may be provided in the form of a matrix. The number of the feeding vias 18*a* connecting the dummy wiring layer 16*c* and the feeding pad 12*c* to each other may be determined by a designed resonance frequency.

According to an example, a resonance frequency of the chip antenna 100 may be controlled by controlling the number of the feeding vias 18*a* connecting the dummy wiring layer 16*c* and the feeding pad 12*c* to each other. For example, as the number of the feeding vias 18*a* increases, the resonance frequency of the chip antenna may increase.

Figure 13:
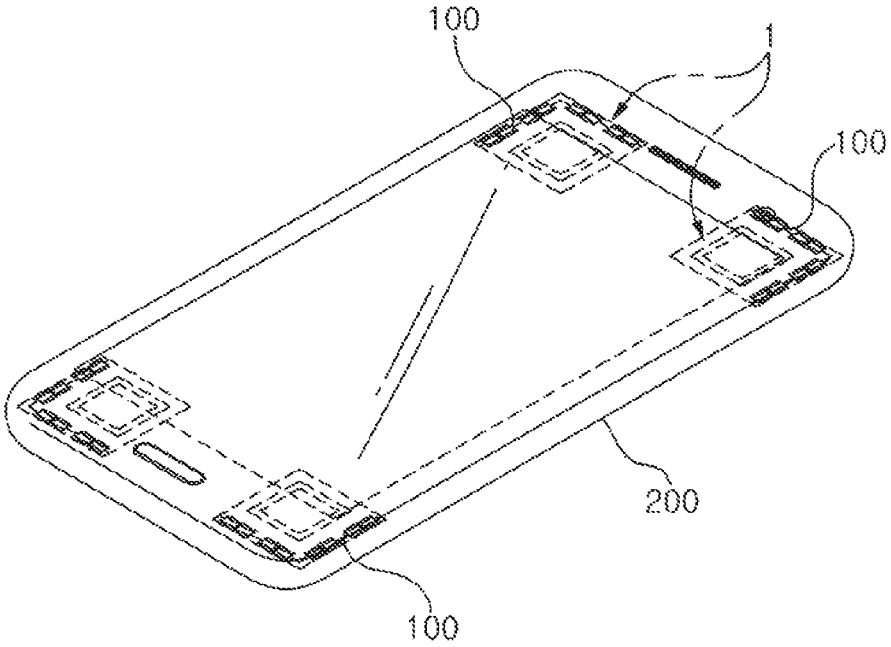
FIG. 13 is a schematic perspective view illustrating a portable terminal in which an antenna module is mounted, according to an embodiment.

FIG. 13 is a schematic perspective view illustrating a portable terminal 200, in which antenna modules 1 are mounted.

Referring to FIG. 13, antenna modules 1 are disposed at corners of a portable terminal 200. More specifically, the antenna modules 1 are respectively disposed adjacent to the corners of the portable terminal 200.

The example of FIG. 13 describes a case in which the antenna modules 1 are disposed at all four corners of the portable terminal 200, but an arrangement of the antenna modules is not limited to the illustrated example, and may be variously modified. For example, if there is insufficient space inside the portable terminal 200, only two antenna modules 1 may be disposed in corners facing each other in a diagonal direction of the portable terminal 200. Furthermore, the antenna module 1 is coupled to the portable terminal 200 such that the feeding region is adjacent to an outer edge of the portable terminal 200. Accordingly, the radio waves radiated through the chip antenna 100 of the antenna module 1 are radiated toward the outside of the portable terminal 200 in a direction of the surface of the portable terminal 200. In addition, the radio waves radiated through the patch antenna 90 of the antenna module 1 are radiated in a thickness direction of the portable terminal 200.

The chip antenna module may use the chip antenna instead of a wiring type dipole antenna, thereby significantly reducing the size of the module. Further, transmission/reception efficiency may be improved.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A chip antenna module, comprising:

a chip antenna comprising a body portion, a radiating portion, and a grounding portion, wherein the body portion is formed of a dielectric substance, and wherein the radiating portion and the grounding portion are disposed on different surfaces of the body portion from each other; and a substrate having a plurality of layers and comprising feeding pads bonded to the radiating portion, grounding pads bonded to the grounding portion, and dummy wiring layers disposed on at least one layer among the plurality of layers, below the feeding pads, wherein a resonance frequency of the chip antenna is determined by a number of the dummy wiring layers.

2. The chip antenna module of claim 1, wherein the resonance frequency decreases as the number of the dummy wiring layers increases.

3. The chip antenna module of claim 1, wherein a feed wiring layer configured to provide a feed signal to the feeding pads is disposed on one or more layers among the plurality of layers.

4. The chip antenna module of claim 3, wherein the feed wiring layer and the dummy wiring layers are disposed on different layers, among the plurality of layers, from each other.

5. The chip antenna module of claim 3, wherein the feeding pads and the feed wiring layer are connected to each other through a feeding via extending in a thickness direction of the substrate.

6. The chip antenna module of claim 5, wherein the feeding pads and at least one of the dummy wiring layers are connected to each other through the feeding via.

7. The chip antenna module of claim 5, wherein the feeding via comprises a plurality of feeding vias, and the resonance frequency is further determined by a number of feeding vias, among the plurality of feeding vias, connecting the feeding pads and at least one of the dummy wiring layers to each other.

8. The chip antenna module of claim 5, wherein the feeding via comprises a plurality of feeding vias, and the resonance frequency increases as a number of feeding vias, among the plurality of feeding vias, increases.

9. A chip antenna module, comprising:

a substrate comprising a plurality of layers; and a chip antenna comprising a body portion, a radiating portion, and a grounding portion, wherein the body portion is formed of a dielectric substance, and the radiating portion and the grounding portion are disposed on different surfaces of the body portion from each other and extend in one direction, wherein the body portion, the radiating portion, and the grounding portion are mounted to face the substrate, wherein the substrate further comprises a feeding pad bonded to the radiating portion, and a dummy wiring layer disposed on at least one layer among the plurality of layers, below the feeding pad, and having a shape corresponding to the feeding pad, and wherein a resonance frequency of the chip antenna is determined by a length of the dummy wiring layer.

10. The chip antenna module of claim 9, wherein the length of the dummy wiring layer is equal to a length of the feeding pad.

11. The chip antenna module of claim 9, wherein the length of the dummy wiring layer is less than a length of the feeding pad.

12. The chip antenna module of claim 9, wherein the length of the dummy wiring layer is greater than a length of the feeding pad.

13. The chip antenna module of claim 9, wherein the resonance frequency decreases as the length of the dummy wiring layer increases.

14. The chip antenna module of claim 9, wherein the feeding pad and the dummy wiring layer are connected to each other by a feeding via extending in a thickness direction of the substrate.

15. The chip antenna module of claim 14, wherein the feeding via comprises a plurality of feeding vias and the resonance frequency is determined by a number of feeding vias, among the plurality of feeding vias, connecting the feeding pad and the dummy wiring layer to each other.

16. The chip antenna module of claim 15, wherein the resonance frequency increases as the number of the feeding vias increases.

17. The chip antenna module of claim 9, wherein the substrate further comprises a feed wiring layer disposed on a layer, among the plurality of layers, between the dummy wiring layer and the feeding pad, and configured to provide a feed signal to the feeding pad.

18. The chip antenna module of claim 9, wherein the substrate further comprises a feed wiring layer disposed on a layer, among the plurality of layers, below the dummy wiring layer, and configured to provide a feed signal to the feeding pad.

* * * * *